US009448030B2

(12) United States Patent
Hines

(10) Patent No.: US 9,448,030 B2
(45) **Date of Patent: *Sep. 20, 2016**

(54) GRIP/COVER FOR KEY LOCK SYSTEM

(71) Applicant: Stephen Charles Hines, Edgewood, NM (US)

(72) Inventor: Stephen Charles Hines, Edgewood, NM (US)

(73) Assignee: Falcon Industries, Inc., Edgewood, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/015,773

(22) Filed: Feb. 4, 2016

(65) Prior Publication Data

US 2016/0169610 A1 Jun. 16, 2016

Related U.S. Application Data

(63) Continuation-in-part of application No. 14/865,692, filed on Sep. 25, 2015, which is a continuation-in-part of application No. 14/593,134, filed on Jan. 9, 2015, now Pat. No. 9,234,721, which is a continuation of application No. 29/478,902, filed on Jan. 9, 2014, now Pat. No. Des. 734,418, application No. 15/015,773, which is a continuation-in-part of application No. 13/800,887, filed on Mar. 13, 2013, now Pat. No. 9,279,639.

(60) Provisional application No. 61/925,451, filed on Jan. 9, 2014, provisional application No. 61/778,407, filed on Mar. 12, 2013, provisional application No. 61/610,281, filed on Mar. 13, 2012, provisional application No. 62/232,393, filed on Sep. 24, 2015, provisional application No. 62/056,172, filed on Sep. 26, 2014.

(51) Int. Cl.
*F41A 17/20* (2006.01)
*F41A 35/00* (2006.01)

(52) U.S. Cl.
CPC ..... *F41A 35/00* (2013.01)

(58) Field of Classification Search
CPC ..... F41C 23/16; F41C 23/10; F41A 17/066; F41A 17/20; F41A 17/02
USPC ..... 42/71.02, 71.01, 72, 90, 70.11, 111
See application file for complete search history.

(56) References Cited

U.S. PATENT DOCUMENTS

| | | | | |
|---|---|---|---|---|
| 3,128,571 | A | 4/1964 | Herrett | |
| 5,392,550 | A | 2/1995 | Moore et al. | |
| 5,522,166 | A * | 6/1996 | Martel | F41G 11/003 42/124 |
| 6,487,804 | B1 | 12/2002 | Petrella, Jr. | |
| 7,627,975 | B1 | 12/2009 | Hines | |

(Continued)

*Primary Examiner* — Michael David
(74) *Attorney, Agent, or Firm* — Richard H. Krukar; Luis M. Ortiz; Kermit D. Lopez

(57) ABSTRACT

Covers for key lock mounting systems on small arms such as the AR or M4 family of rifles and carbines can provide protection for the firearm, comfort for the operator, and electrical power to firearm accessories. The cover has keyhole grips that are pressed into the key lock mounting points in mounting system. The cover is held seated against the surface of the mounting system by the shape and resilience of keyhole grips. V-notch keyhole grips can attach to keyhole shaped mounting points and slot shaped mounting points. The covers have connectors and internal circuitry such that covers lined up edge to edge are electrically connected. Firearm accessories can be electrically powered the connectors.

18 Claims, 11 Drawing Sheets

(56) References Cited

U.S. PATENT DOCUMENTS

| | | | | |
|---|---|---|---|---|
| 8,091,265 | B1 | 1/2012 | Teetzel et al. | |
| 9,222,749 | B1 * | 12/2015 | Nakayama | F41C 23/16 |
| 2003/0106252 | A1 * | 6/2003 | Hines | F41A 35/02 42/90 |
| 2008/0289237 | A1 | 11/2008 | Pikielny | |
| 2009/0241397 | A1 * | 10/2009 | Fitzpatrick | F41C 23/16 42/90 |
| 2010/0175293 | A1 | 7/2010 | Hines | |
| 2010/0192446 | A1 | 8/2010 | Darian | |
| 2010/0192448 | A1 | 8/2010 | Darian | |
| 2010/0214470 | A1 | 8/2010 | Cottagnoud | |
| 2010/0275489 | A1 | 11/2010 | Cabahug et al. | |
| 2011/0000120 | A1 | 1/2011 | Thompson | |
| 2011/0167698 | A1 | 7/2011 | Hogue | |
| 2011/0192066 | A1 | 8/2011 | Kimmel et al. | |
| 2011/0232149 | A1 * | 9/2011 | Fargnoli | F41A 3/54 42/16 |
| 2012/0085013 | A1 * | 4/2012 | Cahill | F41A 35/02 42/96 |
| 2012/0311906 | A1 * | 12/2012 | Troy | F41C 23/16 42/71.01 |
| 2013/0019510 | A1 | 1/2013 | Kemmerer et al. | |
| 2013/0019512 | A1 | 1/2013 | Kemmerer et al. | |
| 2013/0074394 | A1 * | 3/2013 | Larue | F41G 1/28 42/111 |
| 2013/0125441 | A1 | 5/2013 | Westwood et al. | |
| 2014/0013642 | A1 * | 1/2014 | Larson, Jr. | F41C 23/16 42/71.01 |
| 2014/0298703 | A1 * | 10/2014 | Gale | F41C 27/00 42/71.02 |
| 2014/0325889 | A1 * | 11/2014 | Michal | F41G 11/003 42/75.01 |
| 2015/0096215 | A1 * | 4/2015 | Somogy | F41C 23/16 42/71.01 |
| 2015/0128470 | A1 * | 5/2015 | Troy, Jr. | F41C 23/16 42/90 |
| 2015/0192386 | A1 * | 7/2015 | Hines | F41C 23/16 42/71.02 |
| 2015/0198408 | A1 * | 7/2015 | Kincel | F41C 23/16 42/72 |
| 2015/0219422 | A1 * | 8/2015 | Kincel | F41C 23/16 29/525.11 |
| 2015/0241169 | A1 * | 8/2015 | Cheng | F41G 1/00 42/114 |
| 2015/0285583 | A1 * | 10/2015 | Mayberry | F41G 11/005 42/71.01 |
| 2015/0285584 | A1 * | 10/2015 | Mayberry | F41C 23/16 42/71.01 |
| 2016/0084610 | A1 * | 3/2016 | Wood | F41B 11/70 124/80 |
| 2016/0091272 | A1 * | 3/2016 | Hines | F41C 23/16 42/90 |
| 2016/0116252 | A1 * | 4/2016 | Kincel | F41C 27/00 42/90 |

* cited by examiner

GRIP/COVER FOR KEY LOCK SYSTEM

RELATED APPLICATIONS

This application is a continuation-in-part of U.S. patent application Ser. Nos. 14/865,692 and 13/800,887, claims the benefit and priority of U.S. patent application Ser. Nos. 14/593,134 and 29/478,902, and claims the priority and benefit of U.S. Provisional Applications 62/056,172, 62/232,393, 61/925,451, 61/610,281, and 61/778,407. U.S. patent application Ser. No. 14/865,692 was filed Sep. 25, 2015 and titled "Grip/Cover for Key Lock System" is a continuation-in-part of U.S. Ser. No. 14/593,134 and claims the benefit and priority of U.S. Provisional Applications 62/056,172 and 62/232,393. U.S. patent application Ser. No. 14/593,134 was filed Jan. 9, 2015, issued as U.S. Pat. No. 9,234,721 on Jan. 12, 2016, is titled "Cone Grip For Handgun," is a continuation of U.S. patent application Ser. No. 29/478,902 and claims priority and benefit of U.S. Provisional Application 61/925,451. U.S. patent application Ser. No. 13/800,887 filed Mar. 13, 2013 and titled "Powered Forward Module" claims the benefit and priority of U.S. Provisional Patent Applications 61/610,281 and 61/778,407. U.S. patent application Ser. No. 29/478,902 titled "Firearm Grip" was filed Jan. 9, 2014 and issued as Design Patent D734,418 on Jul. 14, 2015. U.S. Provisional Application 62/056,172 is titled "Cover for Key Lock Systems" and was filed Sep. 26, 2014. U.S. Provisional Application 62/232,393 is titled "Grip/Cover For Key Lock Systems" and was filed Sep. 24, 2015. U.S. Provisional Patent Application 61/925,451 is titled "Cone Grip for Handgun" and was filed on Jan. 9, 2014. U.S. Provisional Patent Application 61/610,281 is titled "Powered Forward Module" and was filed on Mar. 13, 2012. U.S. Provisional Patent Application 61/778,407 is titled "Powered Forward Module" and was filed on Mar. 12, 2013. U.S. patent application Ser. Nos. 14/865,692, 14/593,134, 13/800,887, and 29/478,902, are herein incorporated by reference in their entireties. U.S. Provisional Applications 62/056,172, 62/232,393, 61/925,451, 61/610,281, and 61/778,407 are herein incorporated by reference in their entireties.

TECHNICAL FIELD

Embodiments relate to the fields of small arms, firearms, firearm accessories, and firearm accessory mounting systems.

BACKGROUND

One of the most common firearm platforms currently in use forms the basis for the military M-16, M-4, civilian AR-15, and a plethora of related firearms. One of the most convenient aspects of the AR platform family is that the parts and pieces can be mixed and matched to produce a wide variety of firearms having different capabilities, different appearances, and even different calibers. The terms M-16, M-4, and AR are used interchangeably here because they refer to substantially similar firearms.

Current small arms use mounting rail systems for attaching accessories to the small arm. For example, M-4 and M-16 carbines are often fitted with a single piece handguard that incorporates up to four Picatinny rails. Picatinny rails are well known mounting rails that meet the specifications contained in MIL-STD-1913 and MIL-STD-1913 Notice 1. Another mounting rail called the Weaver rail is a notoriously well-known variation of the Picatinny rail. Battaglia discloses a mounting rail system in U.S. Pat. No. 6,792,711 while Olson discloses another in U.S. Pat. No. 5,826,363.

Picatinny rails were attached to or formed into the upper receivers of M-16 style firearms to which sights such as scopes, red dots, and even iron sights have been mounted. Over time, more and more mounting rails have been added to the firearm with current models having mounting rails on the receiver and four mounting rails on the forward hand guard. The reason is that a vast number of rail mountable firearm accessories have become available. Examples of these firearms accessories include the aforementioned sights as well as lasers, flashlights, bayonets, grenade launchers, sling swivels, cameras, bipods, vertical fore grips, and other items. The mounting rails and associated mounting hardware also became heavy as more and more rails and accessories were attached. To address this issue, M-lok and keylock mounting systems were developed as lighter and more ergonomic alternatives.

FIG. 1, labeled as "prior art," illustrates an M-16 type firearm 101 with mounting rails 106. The specific rifle is a flat top model having a mounting rail 106 on the upper receiver 102 as well as the four on the handguard 105. As is standard for M16 type firearms, the handguard 105 is attached to the firearm by being pushed into a front handguard cup 104 by a delta ring 103. The illustrated handguard 101 has four non-powered mounting rails 106 of which three are visible. A number of accessories have been developed to attach to small arms by way of mounting rails 106. The mounting rails have recoil grooves that help lock accessories in place and help users attach accessories in repeatable positions. Note that the term "firearm" used here and throughout this document is intended to include firearm replicas. In general, firearm replicas are toys or models that look substantially like fully functioning firearms and are designed to accommodate the same firearm accessories as those used with fully functional firearms. As such, FIG. 1 can also be a picture of a firearm replica. Certain AR style firearms have "free floating" handguards that do not have a front handguard cup 104 or delta ring 103 but instead are clamped or bolted onto the firearm where the barrel is attached to the upper receiver.

FIG. 2, labeled as "prior art," illustrates a handguard 201 with key lock mounting points 202 and a mounting rail 106. Two types of firearm accessories can be attached to the handguard of FIG. 2. One type is accessories for Picatinny rails that are clamped to the rail 106 and that often interface with the recoil grooves in the mounting rail 106. The second type of accessory is those that attach to the key lock mounting points 202. The keylock mounting points in FIG. 2 are "keyhole shaped" in that they have a larger round hole with a rounded slot extending outward. Other handguards have keylock mounting points that are not keyhole shaped but instead are slots that typically have rounded ends or rounded corners.

FIG. 3, labeled as "prior art," illustrates three keylock mounting points 302 as viewed from the underside which would also be the inside of a keylock mounting system 301. The illustrated keylock mounting points are keyhole shaped with a larger round section 303 and a longer slotted section 304 extending out from the round section 303. The illustrated slotted section 304 has an angled inner surface 305. Other keylock mounting points do not have an angled inner surface 305, round section 303, or either.

FIG. 4, labeled as "prior art," illustrates a cut view of the keylock mounting point of FIG. 2-3. FIG. 4 provides a more detailed view of the angled inner surface 305 of a slotted section 304.

A number of the firearm accessories are electrically powered. Many solutions simply include battery compartments. For example, a flashlight accessory is basically a battery powered flashlight with rail compatible mount points. More recently, solutions are being developed for electrifying the firearms and rail systems. Hines (U.S. Pat. No. 7,627,975) and Thompson (U.S. Patent Application 2011/0000120) teach bringing electrical power to forward mounted accessories. Darian (U.S. Patent Applications 2010/0192446, 2010/0192448, and 2011/0131858) also teaches powering firearm accessories from a firearm rail. Such rails can be referred to as empowered mounting rails.

Keylock mounting points are advantageous because they are lighter than mounting rails but they experience difficulties because it can be more difficult to mount accessories to keylock mounting points than to mounting rails. Certain current art electrified rail systems use powered firearm mounting rails that conduct electrical energy from an electrical input connection to one or more rail mounted devices. Systems and methods providing alternative methods of controlling and attaching electronic and electrified devices are needed.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

Systems and methods for powering electrical and electronic firearm accessories through covers for key lock mounting systems are needed.

It is therefore an aspect of the embodiments to provide a resilient cover that can be fastened to the mounting system and over the keyhole shaped openings. The cover has a main body and covers at least one, typically more, key lock mounting points. The cover uses keyhole grips to attach to the key lock mounting points. The keyhole grips extend from the bottom of the cover's main body and are shaped to fit into the keyhole shaped openings. The keyhole grips widen at the bottom such that they must be forcibly pushed into the keyhole opening. The resilience and shape of the cover material allows the keyhole grip to temporarily deform enough that the keyhole grip can be pushed into the keyhole opening. The keyhole grip is seated when the bottom of the cover's main body lies against the top surface of the mounting system, such as that illustrated in FIGS. 1 and 2. Note that the shape of the keyhole grip causes the resilient material to be deformed less, or be not deformed at all, when the cover is seated.

While useful, a single-grip cover may be prone to rotation. As such, some covers can have two or more keyhole grips spaced to attach to two or more key lock mounting points. Consecutive keyhole grips can fit into consecutive key lock mounting points or can spaced further apart. Areas of the cover overlaying a key lock mounting point and lacking a keyhole grip can have openings to allow heat or rubble to escape through the mounting point.

The cover can be made of a material that is resilient enough that the keyhole grip temporarily deforms during insertion into the key lock mounting point. Once fully inserted, the keyhole grip returns to is original shape or as close to that shape as possible given the dimensions of the keyhole mounting point. The material is also resilient enough that the cover can be repeatedly attached and removed from the key lock mounting system by pulling the cover away from the mounting system and without requiring access to or manipulation of the keyhole grip. The cover material should also be soft enough and resilient enough that the mounting system is not scratched, marred, or permanently deformed when the keyhole grips is pressed through the keyhole opening or when the cover is pulled off the mounting system. For example, a rubber cover can be used on an aluminum or hard plastic mounting system while an aluminum or steel cover is not resilient enough.

The cover has a cover body with the cover body having a cover top, cover bottom, a first end, a second end, and two sides. The covers can carry electrical current between the first end and the second end by incorporating a first circuit. The first circuit has a first connector fixedly located at the first end and a second connector fixedly located at the second end. A conductor inside the cover electrically connects the first connector and the second connector. The covers are designed to be mounted end to end on a mounting system such that the first circuit of one cover is electrically connected to similar circuits in adjacent covers. The first circuit can use a conductive cover body as the conductor between the connectors.

It is another aspect of the embodiments that the covers can have additional circuits substantially similar to the first circuit although only one of the circuits can use the cover body as a conductor. Some embodiments incorporate a circuit board within the covers and can have the connectors mounting on the circuit board.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the background of the invention, brief summary of the invention, and detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof. In general, the figures are not to scale.

Covers for key lock mounting systems on small arms such as the AR or M4 family of rifles and carbines can provide protection for the firearm and comfort for the operator. The cover has keyhole grips that are pressed into the key lock mounting points in mounting system. The cover is held seated against the surface of the mounting system by the shape and resilience of keyhole grips. V-notch keyhole grips can attach to keyhole shaped mounting points and slot shaped mounting points.

U.S. Ser. No. 14/593,134 was filed Jan. 9, 2015, is entitled "Cone Grip For Handgun" and is herein incorporated by reference in its entirety. U.S. Ser. No. 14/593,134 discloses a handgrip having an overmold and a substrate. It is for its teachings of grips, overmolds, and substrates that U.S. Ser. No. 14/593,134 is herein included by reference in its entirety.

Provisional Application 62/056,172 was filed Sep. 26, 2014, is entitled "Cover For Key Lock Systems" and is herein incorporated by reference in its entirety. Provisional Application 62/056,172 discloses prior art keylock systems for mounting accessories to firearms and discloses a variety of embodiments of covers for key lock systems, many of which are also taught in this application. It is for its teachings of keylock systems and covers for keylock systems that Provisional Application 62/056,172 is herein included by reference in its entirety.

Provisional Application 62/232,393 was filed Sep. 24, 2015, is entitled "Cover For Key Lock Systems" and is herein incorporated by reference in its entirety. Provisional Application 62/232,393 discloses prior art keylock systems for mounting accessories to firearms and discloses a variety of embodiments of covers for key lock systems, many of which are also taught in this application. It is for its teachings of keylock systems and covers for keylock systems that Provisional Application 62/232,393 is herein included by reference in its entirety.

Figure 5:
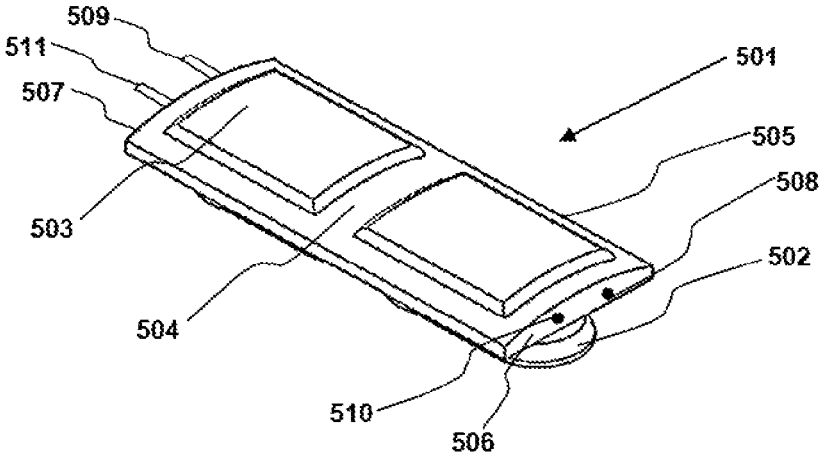
FIG. 5 illustrates a cover having key shaped keyhole grips in accordance with aspects of the embodiments.

FIG. 5 illustrates a cover 501 having key shaped keyhole grips 502 in accordance with aspects of the embodiment. The cover body 505 has raised surface 503 over the keyhole grips and a non-raised surface 504 elsewhere such as between the keyhole grips. The cover 501 has two ends, a first end 506 and a second end 507. The first end 506 has a first connector 508 and a third connector 510. The second end 507 has a second connector 509 and a fourth connector 511. The first connector 508 is electrically connected to the second connector 509 by a conductor such as a wire passing through the cover body 505. The third connector 510 is electrically connected to the fourth connector 511 by a second conductor such as a wire passing through the cover body 505. The first connector 508, second connector 509, and conductor are all parts of a first circuit. The third connector 510, fourth connector 511, and second conductor are all parts of a second circuit. When cover 501 is by itself, as shown in FIG. 5, the first circuit and the second circuit are electrically isolated from one another. For example, the cover body 505 can be formed from an electrical insulator such that electricity cannot flow from the first circuit to the second circuit. Alternatively, an insulated wire having a conductor surrounded by an insulating jacket can electrically connect two of the connectors while the other two connectors are electrically connected by a conductive cover body. The conductor, second conductor or both can be formed from a conductive rubber, plastic, silicone, or other formulation. In another embodiment, the cover body 505 is a conductive rubber, plastic, silicone, or other formation and the first circuit and second circuit are electrically insulted from each other and from the cover body such that the cover body provides electrical shielding to the first circuit and the second circuit.

The connectors of FIG. 5 are pins 509, 511 and sockets 508, 510. A series of covers, all substantially similar to cover 501, can be aligned end to end and plugged into one another to thereby cover a longer area and to also to elongate the first circuit and the second circuit.

Figure 6:
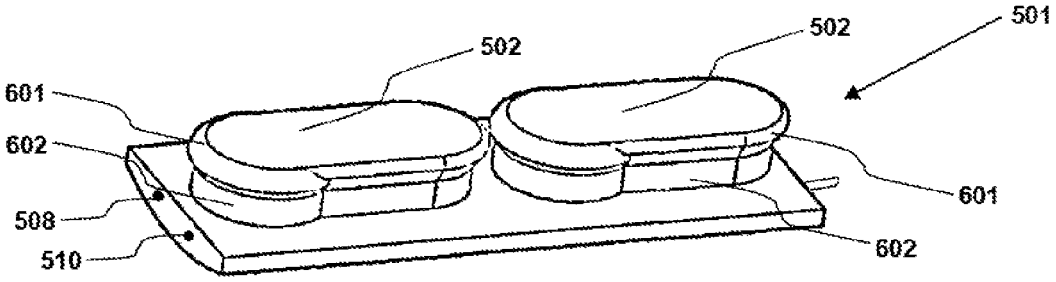
FIG. 6 illustrates a different view of the cover of FIG. 5 in accordance with aspects of the embodiments.

FIG. 6 illustrates a different view of the cover 501 of FIG. 5 in accordance with aspects of the embodiments. The keyhole grips 502 can he seen to be keyhole shaped and to have a narrow part 602 and a wide part that has a rounded lower portion 601. The first circuit and the second circuit are substantially inside the cover body 505 with the connectors 508, 509, 520, 511 accessible at the ends 506, 507 of the cover 501.

Figure 1:
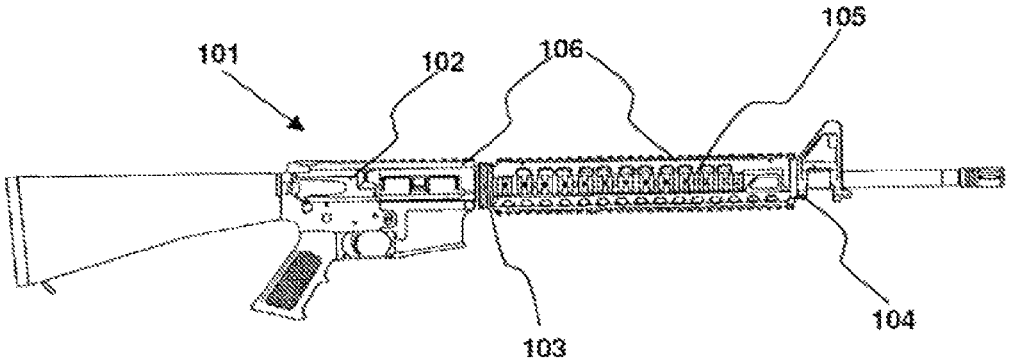
Fig. 1 (Prior Art)
FIG. 1, labeled as "prior art," illustrates an M16 type firearm 101 with mounting rails 106.
Figure 2:
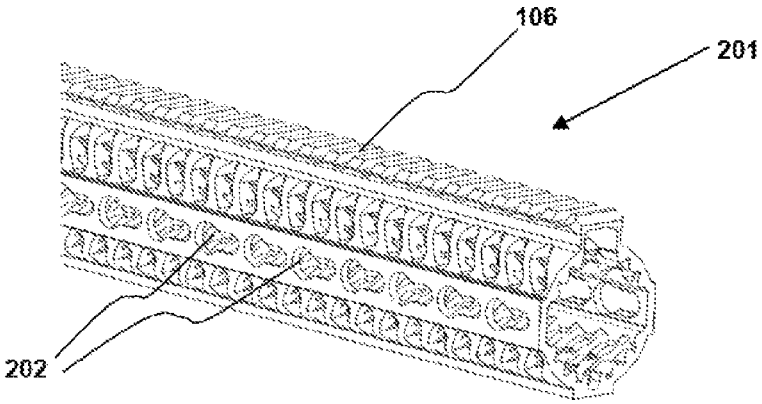
Fig. 2 (Prior Art)
FIG. 2, labeled as "priorart," illustrates a handguard 201 with key lock mounting points 202 and a mounting rail 106.
Figure 3:
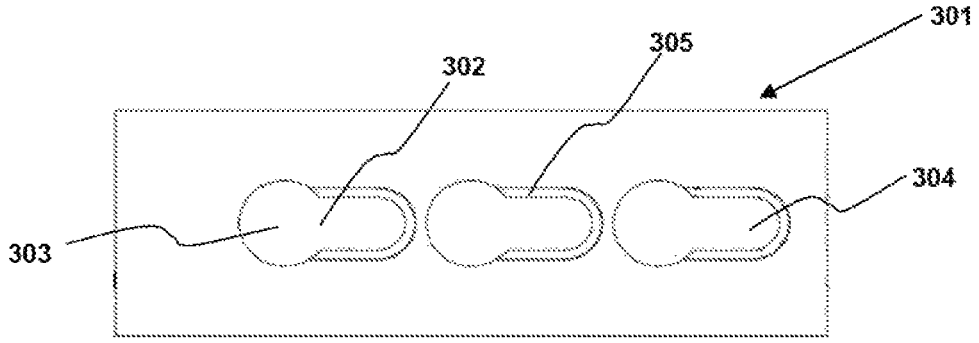
Fig. 3 (Prior Art)
FIG. 3, labeled as "prior art," illustrates three keylock mounting points as viewed from the underside which would also be the inside of the keylock mounting system.
Figure 4:
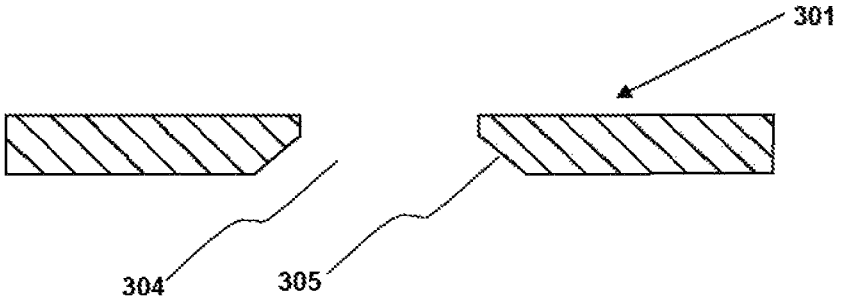
Fig. 4 (Prior Art)
FIG. 4, labeled as "prior art," illustrates a cut view of the keylock mounting point of FIGS. 2-3.
Figure 7:
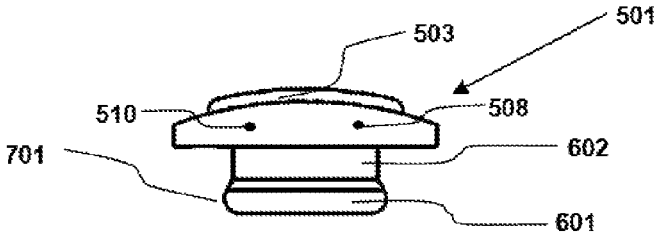
FIG. 7 illustrates a side view of the cover of FIGS. 5-6 in accordance with aspects of the embodiments.

FIG. 7 illustrates a side view of the cover 501 of FIGS. 5-6 in accordance with aspects of the embodiments. The raised surface 503 can be seen as can the narrow part 602 and the wide part 601 of the keyhole grip 502. Also more clearly visible is the widest part 701 of the wide part 601. Pressing the keyhole grip 502 into a key lock mounting point 302 causes the keyhole grip to deform until the widest part 701 has been pressed through the opening. Being made of resilient material, the keyhole grip attempts to return to its original shape and the widest part 701 presses out. When pressed into a mounting point such as that of FIGS. 3-4, the widest part presses out and into the angled inner surface. It is this action of the keyhole grip pressing out and into the side of the keyhole mounting point that holds the cover 501 and all similar covers onto keylock mounting systems. In some embodiments, the firearm grip or fore end can be electrically conductive such that an electrically conductive cover body becomes electrically connected to the fore end when pressed into position on the fore end. Such electrical connectivity can he advantageous for shielding electronics and circuitry or for providing a common electrical ground.

Figure 8:
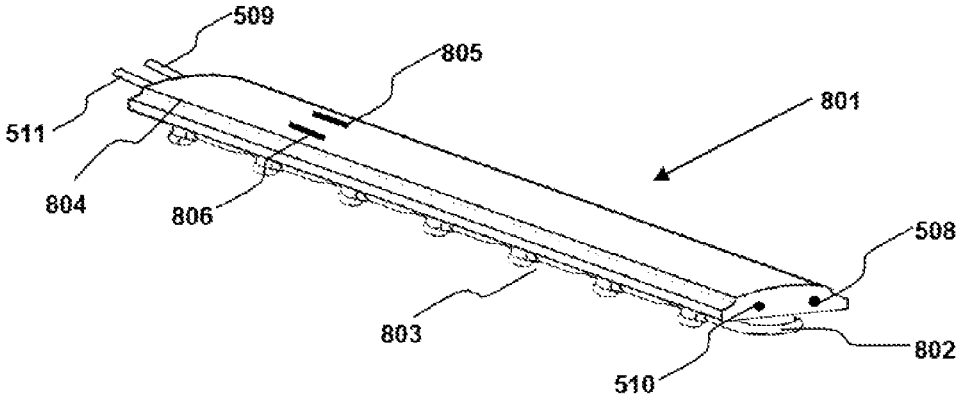
FIG. 8 illustrates a cover having a step-patterned top surface and stepped keyhole shaped keyhole grips in accordance with aspects of the embodiments.

FIG. 8 illustrates a cover 801 having a step-patterned top surface 804 and keyhole grips 802 with stepped wide parts 803 in accordance with aspects of the embodiments. The stepped wide part allows the keyhole grip to better match the stepped contour on the underside of keyhole mounting points such as those of FIGS. 3-4 in which part of the underside has an angled surface and another part does not. This particular cover 801 has two additional socket type connectors 805, 806 through which a firearm accessory can connect to the first circuit and second circuit to thereby be electrically powered by way of cover 801. As illustrated, fifth connector 805 is part of the first circuit while sixth connector 806 is part of the second circuit.

Figure 9:
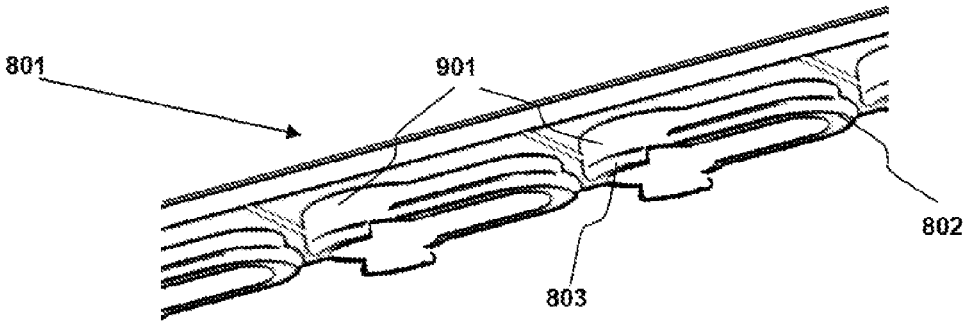
FIG. 9 illustrates a different view of the cover of FIG. 8 in accordance with aspects of the embodiments.

FIG. 9 illustrates a different view of the cover 801 of FIG. 8 in accordance with aspects of the embodiments. As with other keyhole grips, the keyhole grip of FIG. 9 has a narrow part 901. The stepped wide part has a first rounded lower portion 802 and a second rounded lower portion 803.

Figure 10:
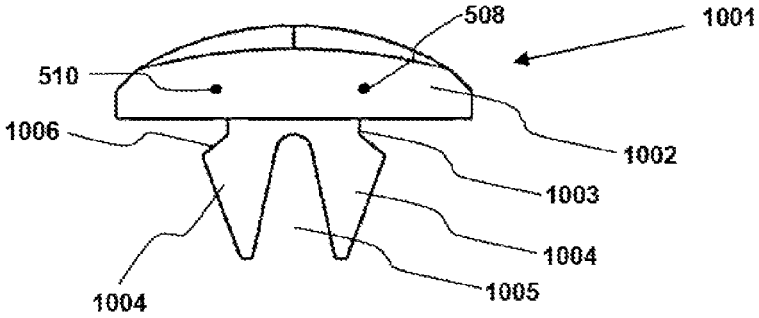
FIG. 10 illustrates a cover with a keyhole grip having two wedges and a v-notch in accordance with aspects of the embodiments.
Figure 11:
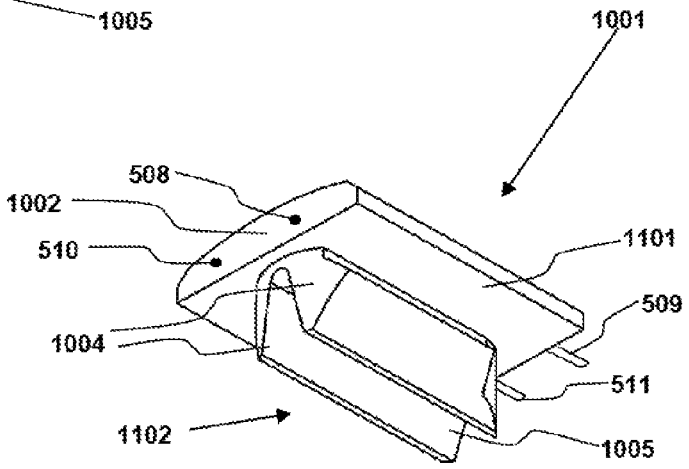
FIG. 11 illustrates a view from the underside of the cover of FIG. 10 in accordance with aspects of the embodiments.
Figure 12:
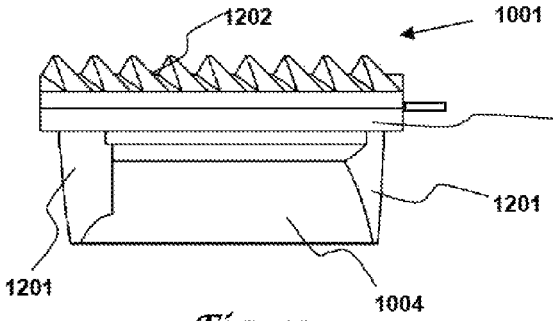
FIG. 12 illustrates a side view of the cover of FIGS. 10-11 in accordance with aspects of the embodiments.
Figure 13:
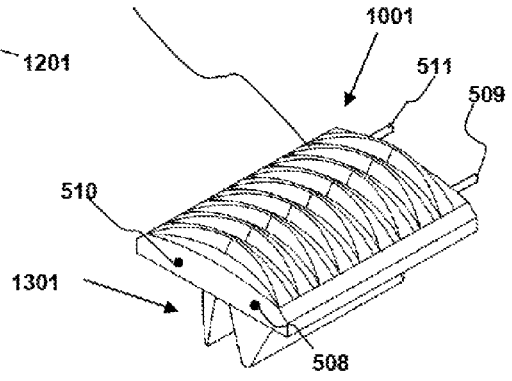
FIG. 13 illustrates a view from above of the cover of FIGS. 10-12 in accordance with aspects of the embodiments.
Figure 14:
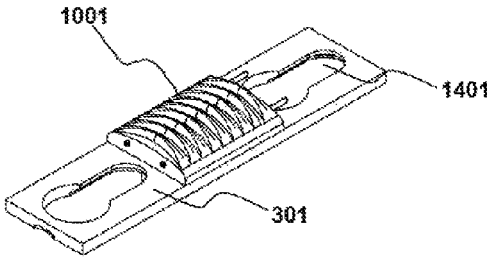
FIG. 14 illustrates a view from above of the cover of FIGS. 10-13 attached to a keyhole mounting point such as that of FIG. 3 in accordance with aspects of the embodiments.
Figure 15:
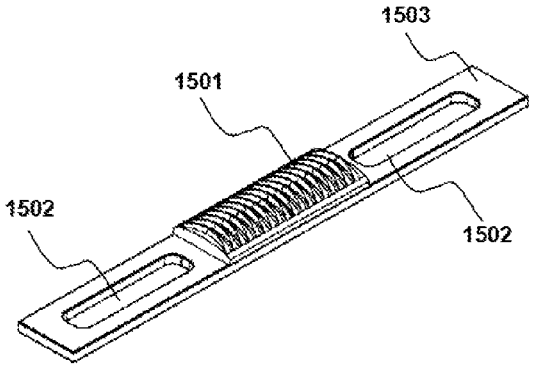
FIG. 15 illustrates a view from above of a cover attached to a slot shaped keyhole mounting point in accordance with aspects of the embodiments.

FIGS. 10-14 illustrate a cover 1001 with a keyhole grip 1102 having two wedges 1004 and a v-notch 1005 in accordance with aspects of the embodiments. The cover has a cover body 1002 with a cover top 1202 and a cover bottom 1101. The keyhole grip 1102 has a narrow part 1103 and a wide part 1301 with the wedges 1004 being part of the wide part. The wedges 1104 have an upper surface 1006. FIG. 12 illustrates an aggressively patterned cover top 1202 whereas other cover tops can be smooth, lightly textured, or otherwise patterned. FIGS. 14-15 show the cover 1001 fixed to a keyhole system 301. The illustrated keyhole system has keyhole shaped keyhole mounting points although cover 1001 can as easily be fixed to slot shaped keyhole mounting points. FIG. 12 shows that this particular embodiment has round ends 1202 that can have a radius equal to that of the rounded slot ends 1401.

FIG. 10 illustrates a front view of the cover of FIGS. 10-14. FIG. 11 illustrates a view from the underside of the cover of FIGS. 10-14. FIG. 12 illustrates a side view of the cover of FIGS. 10-14. FIG. 13 illustrates a view from above of the cover of FIGS. 10-14. FIG. 14 illustrates a view from above of the cover of FIGS. 10-14 attached to a keyhole mounting point such as that of FIG. 3.

FIG. 15 illustrates a view from above of a cover 1501 attached to a slot shaped keyhole mounting point 1502. The illustrated keyhole mounting system 1503 has slot shaped key hole mounting points 1502 instead of the keyhole shaped ones of FIG. 14.

Figure 16:
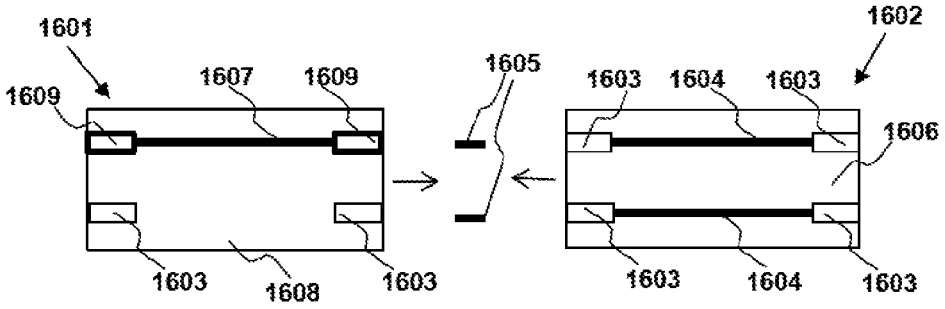
FIG. 16 illustrates two covers connected by free pins in accordance with aspects of the embodiments.

FIG. 16 illustrates two covers 1601, 1602 connected by free pins 1605 in accordance with aspects of the embodiments. Free pins 1605 are pins that can be pulled completely from and re-inserted into compatible sockets such as sockets 1603. Free pins are different from captured pins 509, 511 which are fixed in place and cannot be pulled free without damaging or destroying a connector. Covers 1601 and 1602 can be pressed together end-to-end such that the free pins 1605 are pressed into sockets 1603 such that the cover's 1601, 1602 first circuits are electrically connected and such that the cover's 1601, 1602 second circuits are electrically connected. Cover 1601 and 1602 differ internally but are compatible with one another and can he plugged together as indicated in FIG. 16.

Cover 1602 of FIG. 16 has conductors 1604 that electrically connect the sockets 1603 on opposing ends of the cover 1602. As such, conductors 1604 can be bare wires or conductive channels passing through a non-conductive cover body 1606. The non-conductive cover body 1606 insulates the first circuit (top) from the second circuit (bottom).

Cover 1601 of FIG. 16 has an insulated wire 1607 or insulated conductor connecting insulated sockets 1609. The cover body 1608 of cover 1601 is formed from a conductive material. The first circuit of cover 1601, having insulated sockets 1609 and conductor 1607, is not electrically connected to cover body 1608. Sockets 1603 are not insulated and are electrically connected to cover body 1608. Therefore, the second circuit of cover 1601 includes the two sockets 1603 and the cover body 1608 that electrically connects the two sockets 1603. Note that a cover similar to cover 1602 can be constructed with a conductive body, insulated conductor, and insulated sockets such as those of cover 1601 to thereby produce a cover with conductive body and insulated first and second circuits.

Figure 17:
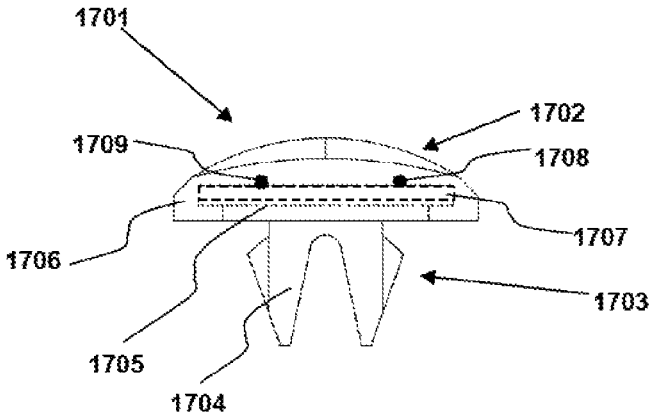
FIG. 17 illustrates a front view of a cover having substrate, overmold, and circuit board in accordance with aspects of the embodiments.
Figure 18:
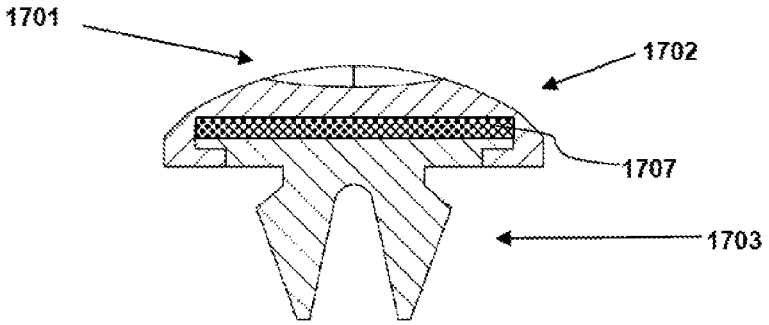
FIG. 18 illustrates a cut view of the cover of FIG. 17 and shows the substrate, overmold, and circuit board in accordance with aspects of the embodiments.

FIGS. 17-18 illustrate a front view of a cover 1701 having a substrate 1703, overmold 1702, and circuit board 1707 in accordance with aspects of the embodiments. The substrate 1703 includes the keyhole grip 1704 and a lower portion 1705 of the cover body 1706. The substrate 1703 is a plastic that provides structural rigidity to the cover while the overmold 1702 is a softer plastic that provides an ergonomic gripping surface and form. The substrate material is not only more rigid than the overmold material but also gives the keyhole grip 1704 a less resilient surface than the overmold material. The less resilient surface is less prone to binding in a key hole mounting point before the keyhole grip is fully inserted. The substrate material typically has a higher melting point than the overmold material such that substrates can be formed first and then overmolds cast directly over and into the substrates. The circuit board should also be able to withstand melted overmold material. An alternative is to attach the connectors and conductors of the first circuit and second circuit directly to the substrate or to cast the substrate around the first and second circuit. Yet another alternative is to form the substrate and overmold separately, assemble the cover with the circuit board properly positioned, and to apply heat or adhesives to bind the components together.

FIG. 17 illustrates a front view of a cover 1701 having substrate 1703, overmold 1703, and circuit board 1707. FIG. 18 illustrates a cut view of the cover 1701 and shows substrate 1703, overmold 1703, and circuit board 1707 in accordance with aspects of the embodiments.

Figure 19:
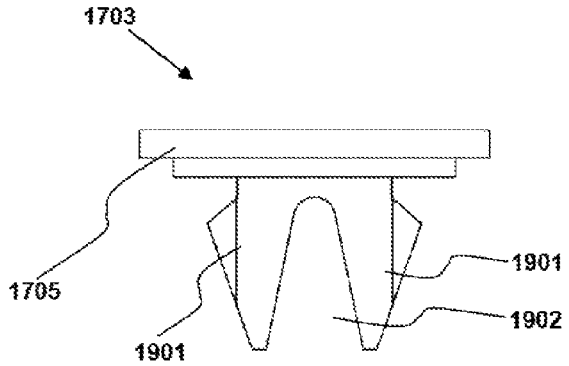
FIG. 19 illustrates a front view of the substrate of the cover of FIGS. 17-18 in accordance with aspects of the embodiments.
Figure 20:
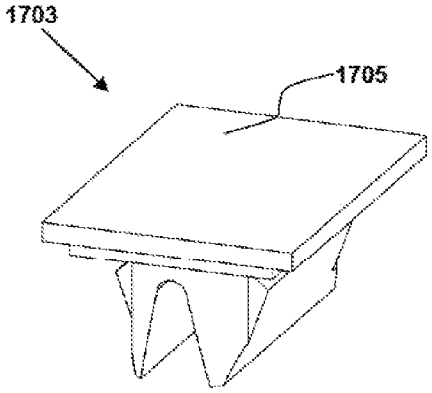
FIG. 20 illustrates a view from above of the substrate of FIG. 19 in accordance with aspects of the embodiments.
Figure 21:
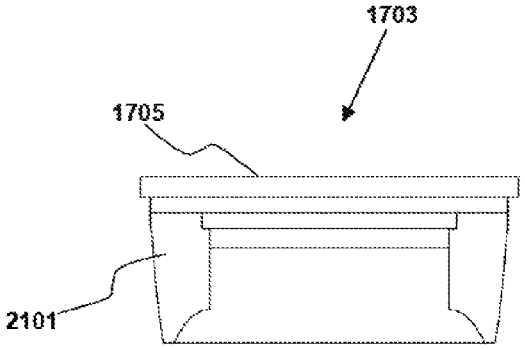
FIG. 21 illustrates a side view of the substrate of FIGS. 19-20 accordance with aspects of the embodiments.

FIGS. 19-21 illustrate aspects of substrate 1703 of FIGS, 17-18, The substrate is can be a single molded piece with the lower cover body 1705 and keyhole grip 1704 which has wedges 1901 and v-notch 1902. It should be noted that the keyhole grip of cover 1701 can be very similar, even identical, in form, to the keyhole grips of other embodiments contemplated herein. Although the substrate material is more rigid than the overmold material, the substrate material must be resilient enough that the keyhole grip can be pressed into a key hole mounting point without breaking and must be resilient enough that the wedges press outward and hold the cover 1701 to the mounting system.

FIG. 19 illustrates a front view of substrate 1703. FIG. 20 illustrates a view from above of substrate 1703. FIG. 21 illustrates a side view of substrate 1703.

Figure 22:
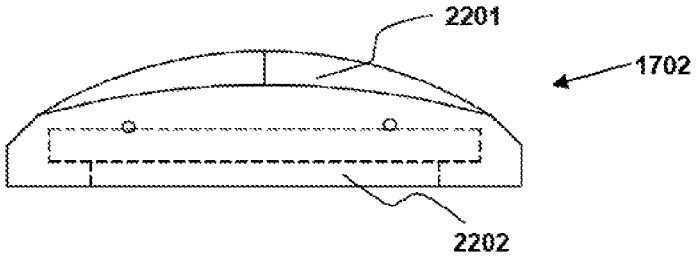
FIG. 22 illustrates a front view of the overmold of the cover of FIGS. 17-18 in accordance with aspects of the embodiments.
Figure 23:
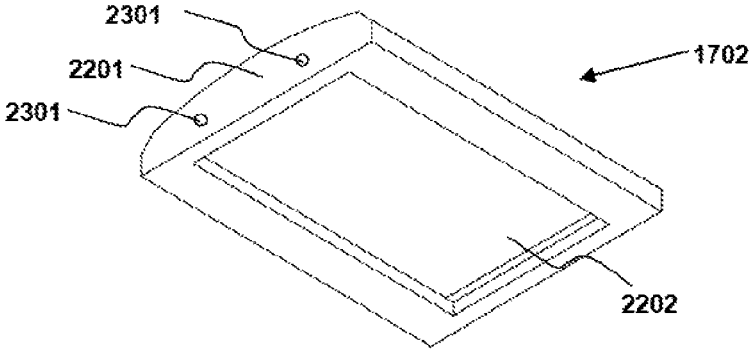
FIG. 23 illustrates a view from below of the overmold of the cover of FIG. 22 in accordance with aspects of the embodiments.

FIGS. 22-23 illustrate a views and aspects of overmold 1702 of cover 1701 of FIGS. 17-18 in accordance with aspects of the embodiments. Overmold 1702 includes the top portion of the cover body 2201 and a cavity 2202 into which the circuit board 1707 and top portion 1705 of the substrate 1703 fits. Holes in the ends of the cover body 2201 provide access to the cover's connectors or for connectors to pass through the ends of the cover body to thereby be accessible.

FIG. 22 illustrates a front view of overmold 1702. FIG. 23 illustrates a view from below of overmold 1702.

An embodiment similar to that of FIGS. 17-23 reverses the overmold and the substrate elements such that the elements illustrated in FIGS. 19-21 become the overmold and are made of the softer more resilient overmold material and such that the elements illustrated in FIGS. 22-23 become the substrate and are made of the harder and less resilient substrate material.

Figure 24:
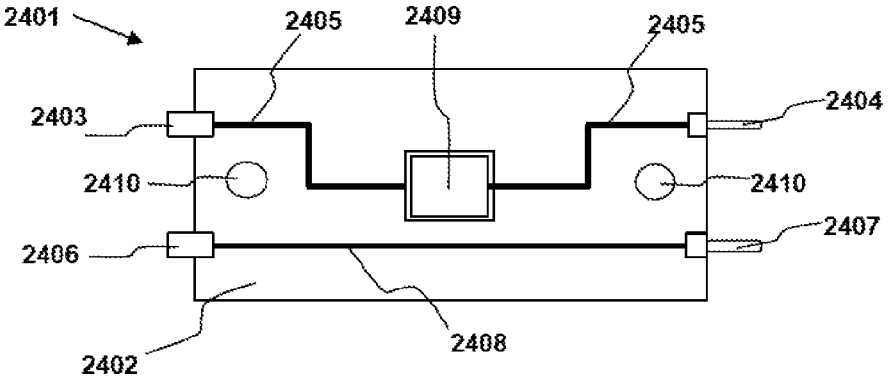
FIG. 24 illustrates a top view of a circuit board in accordance with aspect of the embodiments.

FIG. 24 illustrates a top view of a circuit board 2401 in accordance with aspect of the embodiments. The circuit board 2401 has a substrate 2402 a first circuit and a second circuit. The first circuit has a first connector 2403, second connector 2404, conductor 2405, and switch 2409. Conductor 2405 electrically connects first connector 2403 and second connector 2404. Switch 2409 can interrupt the electrical connection between first connector 2403 and second connector 2404. Another way of describing the first circuit would split conductor 2405 into two conductors with each conductor connecting a connector to the switch such that operating the switch makes and breaks the electrical connection between the connectors. The second circuit has a third connector 2406, fourth connector 2407, conductor 2408 electrically connecting third connector 2406 and fourth connector 2407.

Switch 2409 can be accessible through a hole in cover body or can be operated by pushing onto a spot on the cover body. For example, the cover body can have a thinned area over the switch in order to ease operation of the switch. In such embodiments, successive presses of the switch can make and break the first circuit. Such operation can be achieved mechanically or electronically wherein the switch contains mechanical elements or electronic logic. Such switches are known in the art and can even be purchased as assemblies for mounting on circuit boards.

The circuit board of FIG. 24 is illustrated with the first and third connectors 2403, 2406 sticking past the edge of the circuit board. This provides for the first and third connectors 2403, 2406 to be flush with the ends of the cover body because the circuit board is inside the cover body. Note that the first and third connectors 2403, 2406 are socket connectors, and that the second and fourth connectors 2404, 2407 are pin connectors. Other embodiments can require the pins of adjacent covers to pass into the cover body before reaching the sockets.

Figure 25:
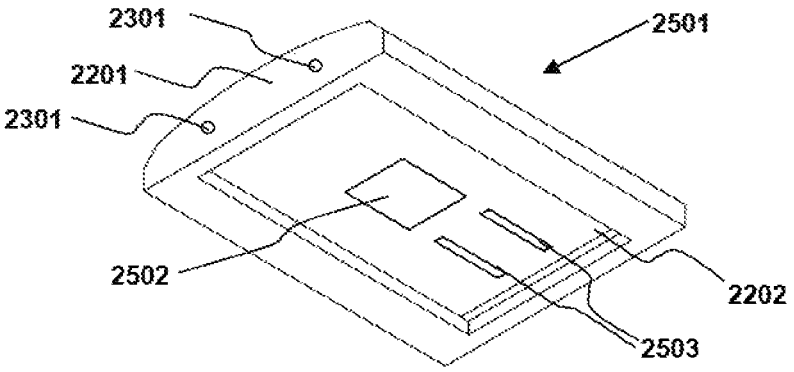
FIG. 25 illustrates a view from below of an overmold for a cover, the overmold having a thinned area for a button and slots for a top connector in accordance with aspects of the embodiments.

FIG. 25 illustrates a view from below of an overmold 2501 for a cover, the overmold 2501 having a thinned area 2502 for a button and slots 2503 for a connectors in accordance with aspects of the embodiments.

Figure 26:
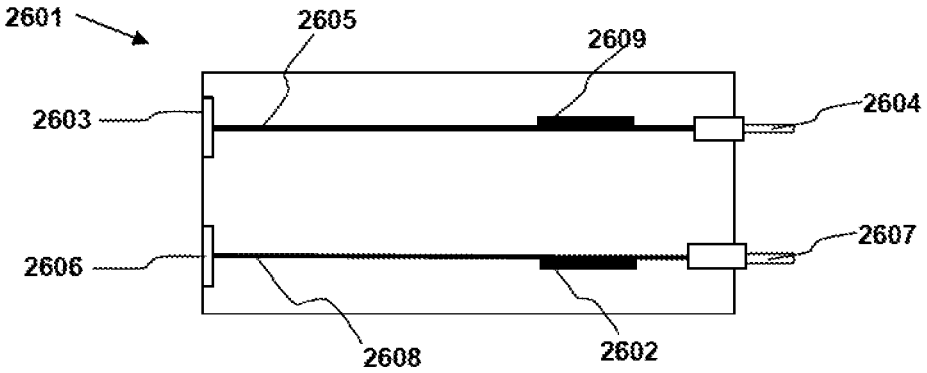
FIG. 26 illustrates a circuit board having pad, pin, and socket connectors in accordance with aspects of the embodiments.

FIG. 26 illustrates a circuit board 2601 having pad 2603, 2606, pin 2604, 2607, and socket connectors 2602, 2609 in accordance with aspects of the embodiments. The pin connectors 2604, 2607 can be spring loaded or magnetic. A spring loaded pin connector has a spring or other element pushing the pin outward from the pin connector housing. When the pin is pushed against a pad connector then the pin can retreat into the pin connector housing such that the pin presses against the pad connector and an electrical contact is maintained between pin and pad. A magnetic pin connector has the pin retracted at least partially into the pin connector housing until a pad connector is brought close. Magnetic attraction causes the pin to extend from the pin connector housing and maintain electrical contact with the pad connector.

The first circuit has first connector 2603, second connector 2604, conductor 2605, and fifth connector 2609. The second circuit has third connector 2606, fourth connector 2607, and sixth connector 2602. The first connector 2603 and third connector 2606 are pad connectors. Second connector 2604 and fourth connector 2607 are pin connectors. Fifth connector 2609 and sixth connector 2602 are socket connectors. Holes in the cover body such as slots 2503 can provide access to the socket connectors which may be wholly within the cover body, flush with the cover body, or extend out of the cover body. Firearm accessories can be attached to a firearm by pressing the accessory into the socket connectors. Other embodiments simply combine the firearm accessory with the cover such that the accessory can be powered or controlled by an adjacent cover.

Figure 27:
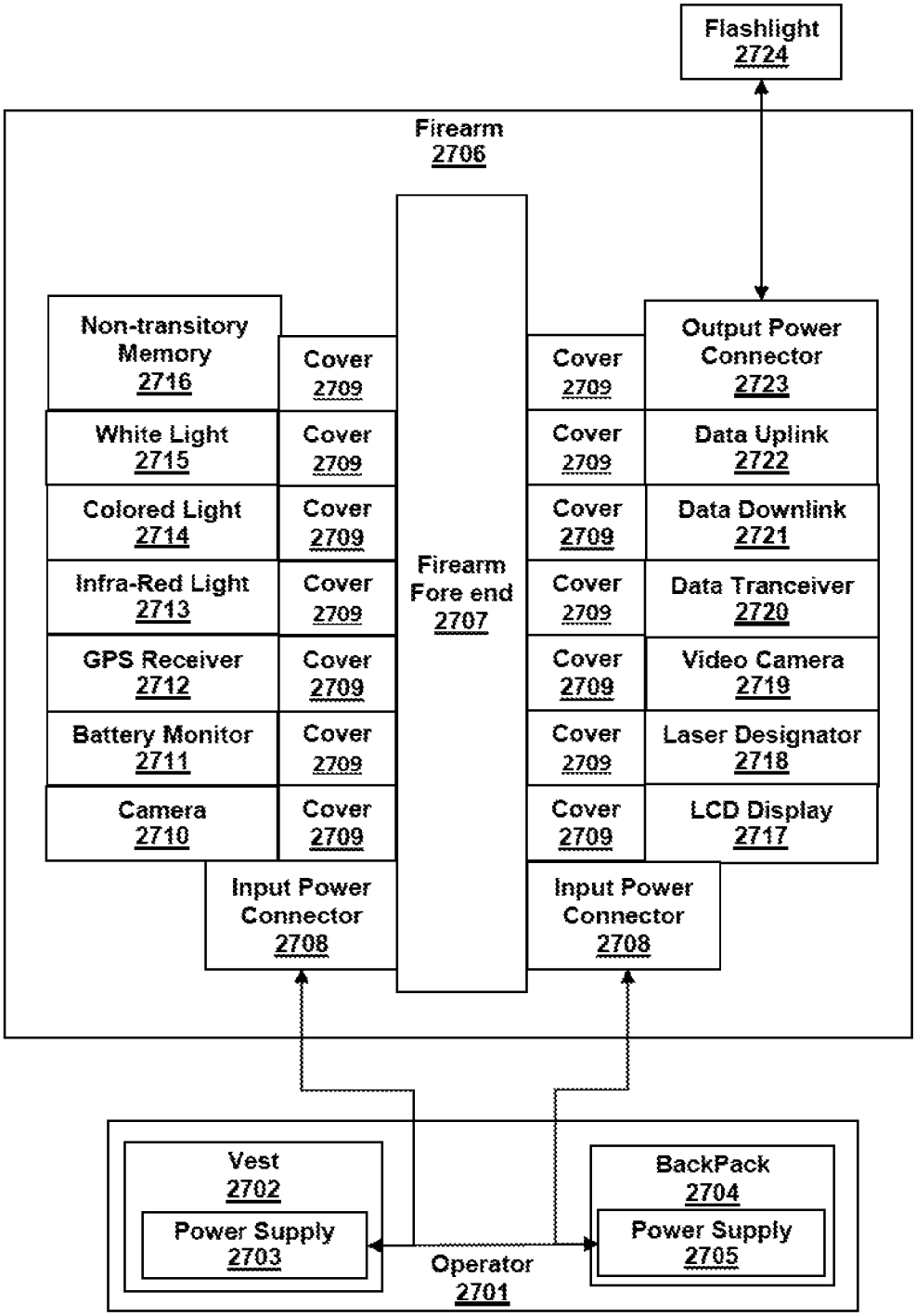
FIG. 27 illustrates a firearm with a covers mounted on the firearms fore end, the covers passing electricity to each other and to various firearm accessories in accordance with aspects of the embodiments.

FIG. 27 illustrates a firearm 2706 with a covers 2709 mounted on the firearm fore end 2707, the covers 2709 passing electricity to each other and to various firearm accessories in accordance with aspects of the embodiments. An operator 2701 can carry the firearm 2706 and wear a vest 2702 or back pack 2704. The vest 2702 can have an integral or attached power supply 2703. Similarly, the back pack 2704 can be fitted with a power supply 2705. The power supplies can supply electrical power to the covers 2709 by way of input connectors 2708 that receive electrical energy and interface electrically with the covers. The covers 2709 are illustrated as lined up on either side of the firearm fore end 2707. As such, the covers 2709 on the left side of the fore end are all electrically connected and receiving power from a power supply 2703, 2705. Similarly, the covers 2709 on the right are all electrically connected and receiving power from a power supply 2703, 2705.

A variety of firearm accessories are connected to the covers 2709 and receiving electrical power from the covers 2709. Note that the accessories can alternatively be integral with the covers. The accessories are a camera 2710, a battery monitor 2711 that can observe the charge state of the power supplies, a GPS receiver 2712, and infra-red light 2713, a colored light 2714, a white light 2715, a non-transitory memory 2716 that can store data received by or produced by another accessory, an LCD display 2717 that can display information provided by another firearm accessory, a laser designator 2718, a video camera 2719, a data transceiver 2720, a data downlink 2721, a data uplink 2722, and an output power connector 2723. The output power connector 2723 is shown powering a flashlight 2724 that is not necessarily mounted on the firearm fore end, for example, the flashlight 2724 can be taped to the firearm barrel or even carried by another operator.

Figure 28:
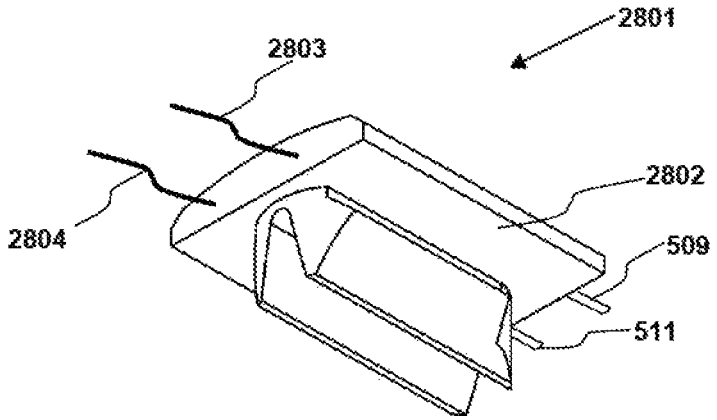
FIG. 28 illustrates an input power connector in accordance with aspects of the embodiments.

FIG. 28 illustrates an input power connector 2801 in accordance with aspects of the embodiments. The illustrated input power connector 2801 can be, essentially, a cover 2801 with wires 2803, 2804 exiting one edge instead of having sockets. The wires are connected internally to the first and second circuits. The opposite edge of the input power connector 2801 can have pins 509, 511 or pads or sockets. Alternatively, an input power connector can simply be a plug similar to the input power connector 2801 of FIG. 28 but lacking the key locking elements. Another alternative embodiment of the input power connector is a plug that plugs into the top sockets of a cover such as sockets 2609, 2502. Yet another embodiment would have wires passing directly through the cover top, side, or bottom and permanently connected to the first and second circuits. Embodiments using a conductive cover body as the conductor in one of the circuits can have a single wire plugged into or permanently fixed to the other circuit. A further embodiment is simply wires plugged into the sockets of a cover such as the cover 501 of FIG. 5.

The output power connector can be substantially similar to the input power connector. An interesting use of the power connectors is that one firearm can be electrically connected to another firearm such that one powers the electrical accessories of the other.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A cover for a firearm fore end comprising a plurality of key lock mounting points, the cover comprising:

an overmold comprising a first resilient material;

a substrate comprising a second resilient material that is not the first resilient material;

a cover body comprising a cover top, a cover bottom, a first end, and a second end;

a keyhole grip comprising a narrow part and a wide part, wherein the keyhole grip is fixed to the cover bottom, wherein the keyhole grip is dimensioned to be pressed into at least one point of the plurality of the key lock mounting points, wherein the keyhole grip comprises the first resilient material or the second resilient material, wherein pressing the keyhole grip into the key lock mounting point causes the wide part to deform more than the narrow part, wherein the narrow part is between the wide part and the bottom of the cover body, wherein the wide part comprises two wedges, wherein pressing the keyhole grip into the key lock mounting point causes the wedges to press together until a widest part of the wide part has passed through the key lock mounting point, wherein the wedges press back apart as the widest part is pressed past the key lock mounting point, and wherein the two wedges are separated by a v-notch; and a first circuit comprising a first connector, a second connector, and a conductor wherein the conductor electrically connects the first connector to the second connector, wherein the first connector is fixedly located at the first end, and wherein the second connector is fixedly located at the second end.

2. The cover of claim 1 further comprising a circuit board wherein the circuit board comprises the conductor, wherein the first connector is fixedly attached to the circuit board, and wherein the second connector is fixedly attached to the circuit board.

3. The cover on claim 2 wherein the first circuit further comprises a switch that controls the flow of electricity between the first connector and the second connector, and wherein the switch is fixedly attached to the circuit board.

4. The cover of claim 2 wherein the first circuit further comprises a switch and a third connector, wherein the switch controls the flow of electricity between the first connector and the third connector, wherein the switch is fixedly attached to the circuit board, and wherein the third connector is accessible through the cover top such that a firearm accessory can be positioned on the cover top and electrically connected to the first circuit.

5. The cover of claim 1 wherein the conductor has a length and wherein the first resilient material fully encapsulates the conductor along the length.

6. The cover of claim 1 wherein the conductor has a length and wherein the second resilient material fully encapsulates the conductor along the length.

7. The cover of claim 1 further comprising a second circuit comprising a third connector, a fourth connector, and a second conductor, wherein the second conductor electrically connects the third connector to the fourth connector, wherein the third connector is fixedly located at the first end, wherein the fourth connector is fixedly located at the second end, and wherein the overmold electrically insulates the second circuit from the first circuit.

8. The cover of claim 1 further comprising a second circuit comprising a third connector, a fourth connector, and a second conductor, wherein the second conductor electrically connects the third connector to the fourth connector, wherein the third connector is fixedly located at the first end, wherein the fourth connector is fixedly located at the second end, and wherein the substrate electrically insulates the second circuit from the first circuit.

9. The cover of claim 1 further comprising a second cover that is identical in form to the cover wherein the second end of the cover is plugged into the first end of the second cover such that the first circuit of the cover is electrically connected to the first circuit of the second cover.

10. The cover on claim 1 wherein the first circuit further comprises a switching device that controls the flow of electricity between the first connector and the second connector.

11. The cover of claim 1 wherein the first circuit comprises a magnetic contact.

12. The cover of claim 1 wherein the first circuit comprises a plug.

13. The cover of claim 1 wherein the first circuit comprises a socket.

14. The cover of claim 1 further comprising a second circuit comprising a third connector, a fourth connector, and a second conductor, wherein the second conductor electrically connects the third connector to the fourth connector, wherein the third connector is fixedly located at the first end, wherein the fourth connector is fixedly located at the second end, and wherein the cover electrically insulates the second circuit from the first circuit.

15. The cover of claim 14 wherein the first circuit further comprises a top connector, wherein the second circuit further comprises a second top connector, and wherein the top connector and second top connector are accessible through the cover top.

16. The cover of claim 7 wherein the first circuit further comprises a top connector, wherein the second circuit further comprises a second top connector, and wherein the top connector and second top connector are accessible through the cover top.

17. The cover of claim 8 wherein the first circuit further comprises a top connector, wherein the second circuit further comprises a second top connector, and wherein the top connector and second top connector are accessible through the cover top.

18. The cover of claim 1 wherein the first circuit further comprises a top connector, and wherein the top connector is accessible through the cover top.

* * * * *